US009677802B2

(12) United States Patent
Lee

(10) Patent No.: US 9,677,802 B2
(45) Date of Patent: Jun. 13, 2017

(54) REFRIGERATOR

(71) Applicant: LG ELECTRONICS INC., Seoul (KR)

(72) Inventor: Seunggeun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 275 days.

(21) Appl. No.: 13/935,140

(22) Filed: Jul. 3, 2013

(65) Prior Publication Data

US 2014/0007609 A1 Jan. 9, 2014

(30) Foreign Application Priority Data

Jul. 4, 2012 (KR) ..... 10-2012-0072643

(51) Int. Cl.
*F25C 5/00* (2006.01)
*F25D 23/12* (2006.01)
*F25C 1/22* (2006.01)

(52) U.S. Cl.
CPC ..... *F25C 5/005* (2013.01); *F25D 23/126* (2013.01); *F25C 1/225* (2013.01); *F25C 2400/10* (2013.01); *F25C 2400/14* (2013.01)

(58) Field of Classification Search
CPC .. F25C 5/005; F25C 1/225; F25C 5/16; F25C 2400/14; F25C 2400/10; F25D 23/126
See application file for complete search history.

(56) References Cited

U.S. PATENT DOCUMENTS 3,969,909 A 7/1976 Barto et al.
7,287,555 B2 * 10/2007 Heger ..... B67D 1/16 141/351
2005/0229623 A1 10/2005 Kim
2006/0144066 A1 7/2006 Lee et al.
2006/0150658 A1 * 7/2006 Schuchart ..... F25D 23/126 62/340
2006/0196214 A1 * 9/2006 Lee ..... F25C 5/005 62/344
2006/0213215 A1 9/2006 Hirano et al.
2007/0095412 A1 5/2007 DuHack et al.
2008/0156027 A1 * 7/2008 Jeong ..... F25C 5/005 62/389
2008/0295537 A1 * 12/2008 An et al. ..... 62/344
2009/0013708 A1 * 1/2009 Truitt ..... F25D 23/126 62/264
2010/0250005 A1 9/2010 Hawkes et al.
(Continued)

FOREIGN PATENT DOCUMENTS

CN 101071026 A 11/2007
CN 201828076 U 5/2011
(Continued)

*Primary Examiner* — Emmanuel Duke
(74) *Attorney, Agent, or Firm* — Birch, Stewart, Kolasch & Birch, LLP

(57) ABSTRACT

A dispenser water supply system including a dispenser, an ice making apparatus and a splitting valve are provided. The dispenser includes an outlet and is configured to dispense water and ice. The ice making apparatus is configured to provide ice to the dispenser. The splitting valve is configured to dispense water into the outlet of the dispenser and to the ice making apparatus to produce ice, the splitting valve being mounted at the dispenser. A refrigerator having the dispenser water system is also provided.

9 Claims, 6 Drawing Sheets

(56) References Cited

U.S. PATENT DOCUMENTS

| | | | | |
|---|---|---|---|---|
| 2010/0275637 | A1 | 11/2010 | Park | |
| 2010/0287971 | A1* | 11/2010 | Lee | F25D 23/126 62/347 |
| 2011/0056222 | A1* | 3/2011 | Lee | F25D 23/126 62/129 |
| 2011/0132021 | A1* | 6/2011 | Fulton et al. | 62/389 |
| 2011/0197620 | A1 | 8/2011 | Kim et al. | |
| 2012/0060540 | A1* | 3/2012 | Yang et al. | 62/340 |
| 2012/0073317 | A1* | 3/2012 | Lee et al. | 62/115 |
| 2012/0111031 | A1 | 5/2012 | Lee et al. | |
| 2012/0111048 | A1 | 5/2012 | Kim et al. | |
| 2012/0152983 | A1* | 6/2012 | Savan | F25D 23/126 222/173 |
| 2014/0041409 | A1 | 2/2014 | An | |

FOREIGN PATENT DOCUMENTS

| | | | | | |
|---|---|---|---|---|---|
| CN | 102401529 | A | | 4/2012 | |
| EP | 1645825 | A1 | | 4/2006 | |
| GB | 2331578 | A | * | 5/1999 | F24H 9/20 |
| KR | 1997-0022171 | A | | 5/1997 | |
| KR | 10-0674573 | B1 | | 1/2007 | |
| KR | 1020070039836 | | * | 4/2007 | |
| KR | 10-2012-0006353 | A | | 1/2012 | |
| KR | 10-2012-0026853 | A | | 3/2012 | |
| WO | WO 2010/112292 | A2 | | 10/2010 | |
| WO | 2011/013953 | A2 | | 2/2011 | |

* cited by examiner

REFRIGERATOR

CROSS-REFERENCE TO RELATED APPLICATIONS

This application claims priority to Korean Patent Application No. 10-2012-0072643 filed on Jul. 4, 2012, the disclosure of which is incorporated by reference herein in its entirety.

BACKGROUND OF THE INVENTION

Field of the Invention

The present invention concerns a refrigerator, and more specifically, to a water supply system of a dispenser of a refrigerator to prevent water from dripping.

Description of Related Art

A refrigerator is a box-shaped appliance for storing food at a low temperature to keep the food fresh. Home refrigerators also may include a freezing apparatus for freezing water or food. A home refrigerator generally relies on vapor compression using a motor and a compressor installed in a sealed container to provide cooling and freezing, particularly, as a liquid coolant flows from the compressor through an expansion valve to an evaporator such that cooling is performed.

As life styles have changed, refrigerators have grown bigger so that they may retain more food. So-called "side-by-side" type refrigerators having both a refrigerating compartment and a freezing compartment laterally separated from each other have gained popularity for home refrigerators. Further, refrigerators have developed a diversity of functions and designs.

Generally, a refrigerator may have an ice making apparatus for making ice and a dispenser through which cool water or ice may be dispensed to the outside without requiring a user to open the doors of the refrigerator. However, when a user dispenses water out of the dispenser by manipulating the water supply operating unit, for example, by pushing a water supply lever with a cup or pressing a water supply button, the water may continue to drip out of a water outlet of the dispenser even when the water supply lever or water supply button is no longer being manipulated.

BRIEF SUMMARY OF THE INVENTION

Accordingly, the present invention has been conceived in consideration of the problem identified above, and an object of the present invention is to address such water leakage.

To achieve the above-objects, according to an embodiment of the present invention, a dispenser water supply system includes a dispenser for withdrawing water and ice and a splitting valve for distributing introduced water into an outlet of the dispenser and an ice making apparatus providing ice to the dispenser, wherein the splitting valve is mounted in the dispenser.

In an embodiment, the splitting valve may be mounted next to the outlet that is positioned at an upper side in the dispenser.

In an embodiment, the dispenser water supply system may further include a display for displaying an operation status of the dispenser.

In an embodiment, the dispenser water supply system may further include a control module for controlling the splitting valve.

In an embodiment, a dispenser cover for hiding the splitting valve may be mounted at an upper side of the dispenser, and a hole may be formed in a portion of a lower surface of the dispenser cover, which is positioned close to the splitting valve.

In an embodiment, the portion of the lower surface of the dispenser cover, which is positioned close to the splitting valve, may be formed to be curved downwards.

In an embodiment, the display for displaying the operation status of the dispenser may be exposed at a front surface of the dispenser cover.

In an embodiment, the splitting valve may shut on and off the flow of water by a solenoid valve, and the splitting valve may be arranged to shut on and off the flow of water as the solenoid valve moves up and down.

According to another embodiment of the present invention, a refrigerator includes an ice making apparatus for generating ice, a dispenser for withdrawing water and the ice generated in the ice making apparatus, and a splitting valve for distributing introduced water into an outlet of the dispenser and the ice making apparatus, wherein the splitting valve is mounted in the dispenser, and wherein the ice making apparatus and the dispenser are mounted in a freezing compartment door.

In an embodiment, the splitting valve may be mounted next to an outlet that is positioned at an upper side of an inside of the dispenser.

In an embodiment, a board may be attached on the freezing compartment door, the board including one or more of a display for displaying an operation status of the dispenser, one or more manipulating buttons for manipulating the dispenser, and a control module for controlling the splitting valve.

In an embodiment, a dispenser cover for hiding the splitting valve may be mounted at an upper side of the dispenser, and the display may be exposed at a front surface of the dispenser cover.

In an embodiment, a hole may be formed at a portion of a lower surface of the dispenser cover, which is positioned close to the splitting valve.

In an embodiment, the portion of the lower surface of the dispenser cover, which is positioned close to the splitting valve, may be curved downward.

In an embodiment, the splitting valve may shut on and off the flow of water by a solenoid valve, and the splitting valve may be arranged so that the flow of water is shut on and off as the solenoid valve moves up and down.

In an embodiment, the splitting valve may be connected to a first hose that passes through an inside of a door hinge for rotating the freezing compartment door so that water is introduced.

In an embodiment, water introduced through the first hose in the splitting valve may be supplied to the outlet through a second hose exposed in the dispenser and may be provided to the ice making apparatus through a third hose.

In an embodiment, first ends of the first and third hoses may be exposed in the dispenser, and part thereof may be embedded in a space between an inner case and an outer case of the freezing compartment door.

In an embodiment, the freezing compartment door may be subjected to a foaming process after the first and third hoses are fixed to the outer case of the freezing compartment door.

In an embodiment, the refrigerator may be of a side-by-side type which has a freezing compartment and a refrigerating compartment separated from each other in a left and right direction.

As such, by reducing the length of a flow path between the dispenser and the valve, the water leakage may be prevented, thus resulting in water supply being stopped at a user's desired time.

Further, a proper amount of water may be supplied into the ice making apparatus.

Still further, the number of connectors for hose connecting may be reduced, thus saving costs and addressing water leakage that occurs between a connector and a hose.

Yet still further, a valve is mounted in the dispenser at the front surface of the door. Accordingly, when the valve is broken in the future, the refrigerator may be easily repaired.

BRIEF DESCRIPTION OF THE DRAWINGS

The embodiments of the present invention will become readily apparent by reference to the following detailed description when considered in conjunction with the accompanying drawings wherein.

DETAILED DESCRIPTION OF THE INVENTION

Hereinafter, exemplary embodiments of a refrigerator according to the present invention will be described in detail with reference to the accompanying drawings.

A refrigerator having an ice making apparatus or a dispenser includes a water supply system for supplying water to the ice making apparatus or the dispenser. The water supply system includes a filter, a water tank, a valve, and a hose. The water supply system purifies water supplied from an external water source through the filter, turns on or off the supply of water from the external water source under the control of the valve, and distributes the purified water to an ice maker or the water tank.

Figure 1:
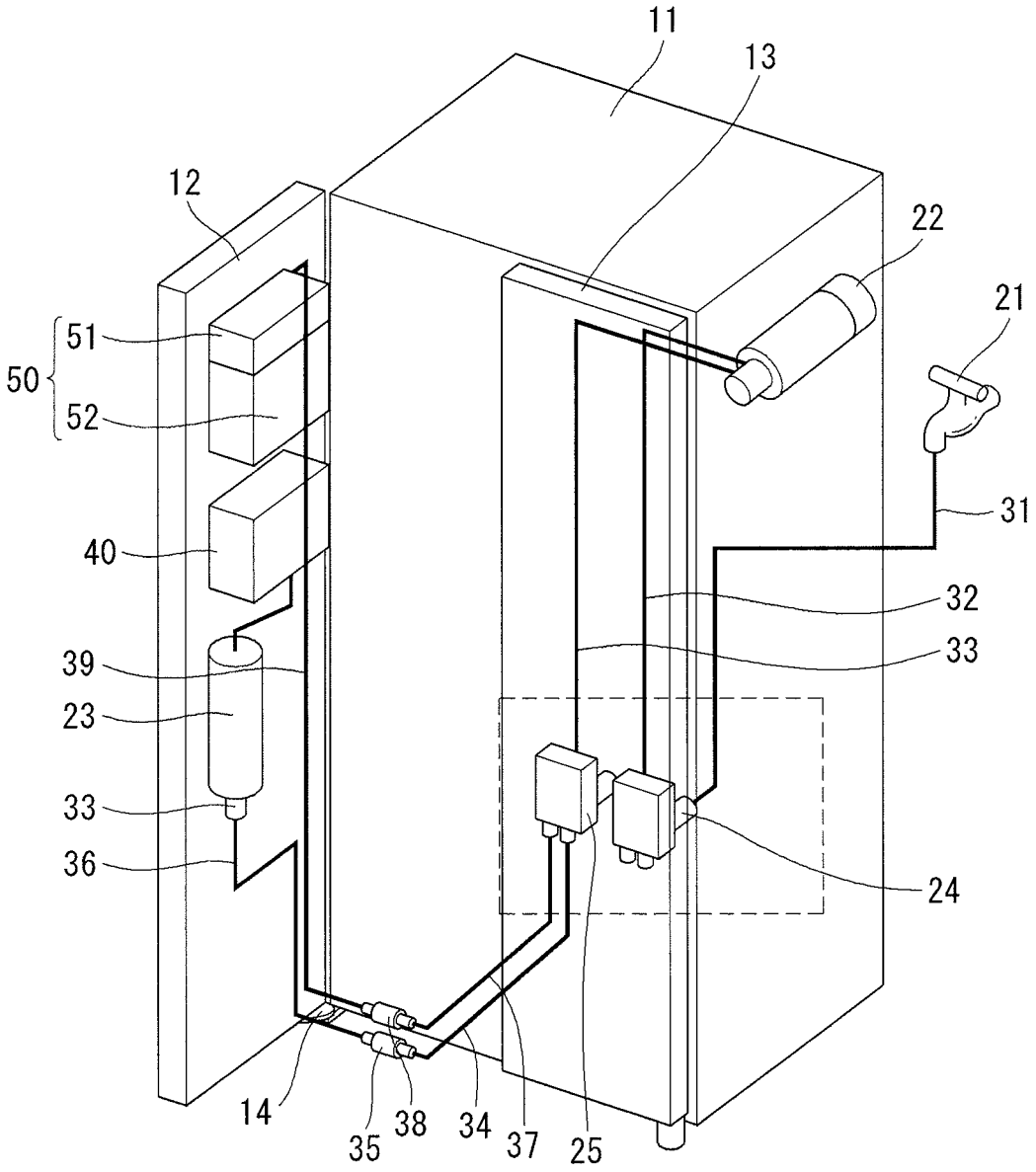
FIG. 1 schematically shows a water supply system of a conventional side-by-side type refrigerator having an ice making apparatus and a dispenser at a freezing compartment door.

FIG. 1 schematically shows a water supply system of a conventional side-by-side type refrigerator having an ice making apparatus and a dispenser at a freezing compartment door.

The side-by-side type refrigerator includes a main body 11 that is shaped as a rectangular parallelepiped and forms a storage space. The refrigerator includes a freezing compartment door 12 and a refrigerating compartment door 13 for opening and closing the storage space. The main body 11, the freezing compartment door 12, and the refrigerating compartment door 13 form an outer appearance of the refrigerator. The freezing compartment door 12 and the refrigerating compartment door 13 each may have a handle and each may be rotated left or right by a door hinge 14.

The main body 11 is separated into a left side and a right side to form a freezing compartment and a refrigerating compartment, respectively. Multiple shelves and drawers are provided in the refrigerating compartment and freezing compartment in order to receive food. At an upper side of the freezing compartment a cold air hole may be provided to introduce cold air into the freezing compartment.

An apparatus for users' convenience may be provided at the front surface of the refrigerator door, as shown in FIG. 1. A home bar may be configured at the front surface of the refrigerating compartment door 13 and a dispenser 40 may be provided at the front surface of the freezing compartment door 12, which allows ice cubes made inside the door and purified water to be easily dispensed to the outside of the refrigerator.

At the rear surface of the freezing compartment door 12 is provided an ice making apparatus 50 that includes an ice maker 51 for making ice cubes and an ice bank 52 that is positioned under the ice maker 51 to store ice cubes. The ice cubes stored in the ice bank 52 may be discharged through an ice chute, which is a path, into the dispenser 40 provided at the front surface of the freezing compartment door 12.

Figure 2:
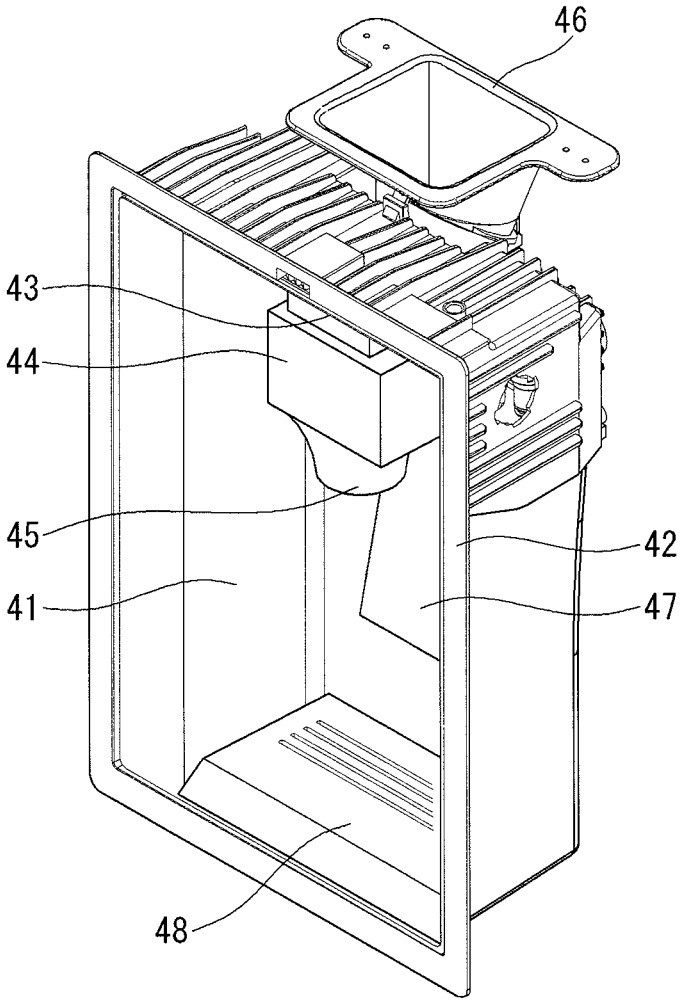
FIG. 2 shows a dispenser through which both water and ice may be withdrawn.

FIG. 2 shows a dispenser through which both water and ice may be withdrawn.

The dispenser 40, which is provided at the front surface of the freezing compartment door 12, may include a dispenser case 42 that is depressed inwards from the front surface of the freezing compartment door 12 to form a dispenser room 41 for placing therein a container for receiving water and ice, a water outlet 43 through which water is discharged, a water manipulating lever 44 for turning on or off a switch for generating an operation signal that enables water to be discharged through the water outlet 43, an ice outlet 45 through which ice stored in the ice bank 52 is discharged to the dispenser room 41, an ice chute 46 that is a path for connecting the ice outlet 45 with the ice bank 52, an ice manipulating lever 47 for controlling discharge of ice through the ice outlet 45, and a bottom plate 48 configured detachably to receive any remaining water that is dripped from the dispenser 40. A hose, which may be a water supply tube, is connected to the water outlet 43 to supply water.

At an upper side of the dispenser 40 may be provided a dispenser cover having a display for displaying operation statuses of the refrigerator and manipulating buttons for manipulating the operation of the dispenser 40 or the refrigerator. The dispenser cover may function to cover some of the parts constituting the dispenser 40 so the parts are not viewed from the outside.

When the water manipulating lever 44 and the ice manipulating lever 47 are manipulated by a user, for example, when pressed, water or ice may start to be dispensed. Supply of water or ice may be continued while the user keeps pressing or until the user re-manipulates the levers 44 and 47.

The water supply system for supplying water to the ice maker 51 and the dispenser 40, as shown in FIG. 1, may include a filter 22 for purifying water supplied from a water supply source 21, for example, a faucet, a water tank 23 for cooling the water purified by the filter 22 and supplying the cooled water to the dispenser 40, a switching valve 24 for switching on/off the supply of water from the water supply source 21, a splitting valve 25 for distributing the water purified by the filter into the water tank 23 or the ice bank 52, hoses 31, 32, 33, 34, 36, 37, and 39 for connecting the water supply source 21, the filter 22, the water tank 23, the switching valve 24, the splitting valve 25, and the ice bank 52 to each other, and connectors 35 and 38 for connecting the hoses to each other.

The filter 22 is mounted at an upper side of the refrigerator, and the water tank 23 is mounted at the freezing compartment door as shown in FIG. 1. However, the water tank 23 may also be positioned in the refrigerating compartment. The switching valve 24 and the splitting valve 25 are arranged in a mechanical chamber that is positioned at a rear and lower side of the refrigerator.

As shown in FIG. 1, the hoses 36 and 39 are buried in the freezing compartment door 12, and the hoses 34 and 37 come from the splitting valve 25 through the outside of the main body 11 to a lower side of the refrigerator. Accordingly, during production of the refrigerator, when the main body 11 is combined with the freezing compartment door 12, the hoses 34 and 36 and the hoses 37 and 39 are connected using the connectors 35 and 38. The hoses 36 and 39, which are buried in the freezing compartment door 12, penetrate the inside of the hinge 14 and ends thereof are exposed to the outside, when the hoses 36 and 39 are supplied to the production line, and are thus connected to the hoses 34 and 37 through the connectors 35 and 38.

If a user manipulates the water manipulating lever 44 of the dispenser 40, a control board (not shown) having a microcomputer installed at the rear surface of the refrigerator receives a switching signal that is generated as the water manipulating lever 44 is manipulated and sends a control signal to a solenoid that opens or closes a first valve of the splitting valve 25 connected to the water outlet 43 of the dispenser 43 (connected in the order of the hose 34, connector 35, hose 36, and water tank 23) and/or to a solenoid that opens or closes the switching valve 24, so that the first valve and/or the switching valve 24 are opened or closed.

Likewise, unless the ice bank 52 is filled with ice at a proper level, the ice maker 51 drops the ice formed in the ice tray to the ice bank 52 and generates a signal for requesting that water be supplied to the ice tray and transfers the signal to the control board. Accordingly, a solenoid of a second valve of the splitting valve 25 connected to the water supply unit of the ice maker 51 (connected in the order of the hose 37, the connector 38, and the hose 39) and/or the solenoid of the switching valve 24 is controlled, so that water is supplied to the ice tray of the ice maker 51, and after a predetermined time passes, for example, sufficient to provide a proper amount of water to the ice tray, the second valve and/or the switching valve 24 is closed.

The first valve of the splitting valve 25 connected to the water outlet 43 of the dispenser 40 is opened, allowing water to be dispensed through the water outlet 43. In this arrangement, if a user manipulates the water manipulating lever 44 to stop water from being withdrawn, the solenoid of the first valve is operated by a control signal from the control board, so that the first valve is closed. However, water can continue to leak through the water outlet 43 for a predetermined time because of the presence of water in the hose and momentum of the water flowing from the first valve to the water outlet 43. This phenomenon may also occur at the second valve of the splitting valve 25, which is connected to the ice maker 51 for forming ice.

The time during which such phenomenon lasts is proportional to the length of a flow path between the start point where the water starts to flow and the end point. That is, as the flow path between the start point and the end point gets shorter, less water can leak due to the water momentum, and as the flow path between the start point and the end point gets longer, more water can leak.

In the refrigerator shown in FIG. 1, the switching valve 24 and the splitting valve 25 are arranged in a mechanical chamber that is positioned at a rear and lower side of the refrigerator. This arrangement prevents water, which may leak when the switching valve 24 breaks, the splitting valve 25, breaks or other leaks are formed between the valve and the hose, from entering the inside of the refrigerator.

Further, the switching valve 24 or the splitting valve 25 switches on/off water supply in a solenoid-operated manner. As such, there is a limit on the size of the valve to switch on/off water flow that can be used to provide higher stability without water leakage, and accordingly, there may not be a proper place to arrange the switching valve 24 or the splitting valve 25, so that the switching valve 24 or the splitting valve 25 may be required to be positioned in the mechanical chamber.

Since the splitting valve 25 is positioned at the rear and lower side of the refrigerator, the length of the hose between the splitting valve 25 and the dispenser 40, i.e., flow path, is increased. Further, because the ice maker 51 for forming ice and the dispenser 40 are embedded in the freezing compartment door 12, the hose for connecting the splitting valve 25 with the water outlet 43 of the dispenser 40 cannot penetrate the freezing compartment and, consequently, is detoured by passing through the inside of the door hinge 14, which may be a shaft about which the freezing compartment door 12 is rotated, and then extending to the inside of the freezing compartment door 12. As such, the flow path between the start point of the splitting valve, where water starts to flow, and the end point of the water outlet of the dispenser or ice maker is long, such that it takes longer for the switch-off of the valve to work on the water outlet, thus resulting in more water dripping.

According to the present invention, the length of the flow path between the splitting valve 25 which is the start point of water flow and the water outlet 43 of the dispenser 40 which is the end point of water flow may be reduced to mitigate water leakage. For this purpose, according to an embodiment of the present invention, the splitting valve, which has been conventionally positioned in the mechanical chamber, is arranged in an empty space of the dispenser that is positioned at the front surface of the freezing compartment door, thus minimizing the length of the flow path between the splitting valve and the water outlet of the dispenser.

Figure 3:
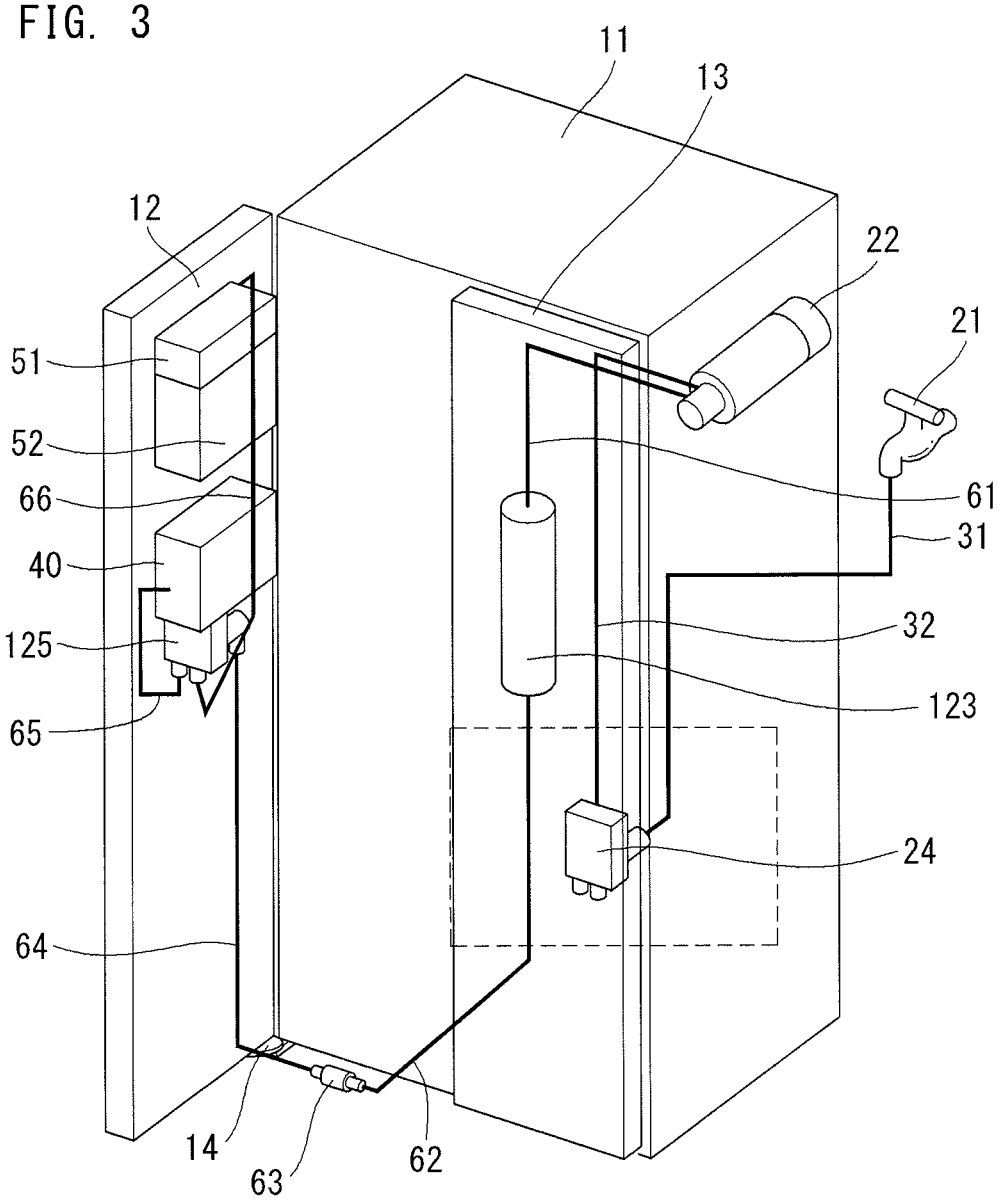
FIG. 3 schematically shows a water supply system of a side-by-side type refrigerator having an ice making apparatus and a dispenser embedded in a freezing compartment door according to an exemplary embodiment of the present invention.

FIG. 3 schematically shows a water supply system of a side-by-side type refrigerator having an ice making apparatus and a dispenser embedded in a freezing compartment door according to an embodiment of the present invention.

The water supply system, as shown in FIG. 3, is similar to the water supply system shown in FIG. 1. However, the splitting valve 25 shown in FIG. 1 is mounted in the mechanical chamber while the splitting valve 125 shown in FIG. 3 is arranged in the freezing compartment door 12. Similarly, while the water tank 23 shown in FIG. 1 is arranged between the splitting valve 25 and the dispenser 40, the water tank 123 shown in FIG. 3 is arranged between the filter 22 and the splitting valve 25. In the exemplary embodiment illustrated in FIG. 3, the water tank 123 is arranged in the refrigerating compartment. However, the present invention is not limited thereto, and the water tank 123 may be mounted in the freezing compartment door 12 similar to the water tank 23 shown in FIG. 1.

Due to such differences, the connection of hoses and drain tubes are changed. As shown in the exemplary embodiment, a hose 61 connects the filter 22 with the water tank 23. A hose 62, a connector 63, and a hose 64 connect the water tank 123 with the splitting valve 125. Hoses 65 and 66 connect the splitting valve 125 to the water outlet 43 of the dispenser 40 and the ice maker 51. Because the splitting valve 125 is embedded in the freezing compartment door 12, the hose 64 directly connected with the splitting valve 125 is also embedded in the freezing compartment door 12, passes through the inside of the door hinge 14 positioned at a lower side of the freezing compartment door 12, with an end thereof exposed to the outside, and is connected to the hose 62 through the connector 63.

While the conventional refrigerator shown in FIG. 1 has two hoses passing through the inside of the door hinge 14, only one hose passes through the door hinge 14 in an exemplary embodiment shown in FIG. 3. The door hinge 14 may be a middle shaft that enables the door to be rotated, and whenever the freezing compartment door 12 is rotated, the hose passing through the door hinge 14 may also move, such that the surface of the hose may be worn away due to possible friction between the hose and the door hinge 14.

To prevent such problems, an internal hole (internal diameter of the hinge) of the door hinge 14 which has been bored to pass the hose therethrough needs to be increased. In such cases, the distance between the internal diameter of the hinge and the external diameter of the hinge is decreased such that the door hinge 14, which is the rotational center of the door, may also be weakened. Thus, the external diameter of the door hinge 14 also needs to be increased. This, in turn, may require the door hinge 14 to be positioned outside the inner wall of the refrigerator so that the drawers in the refrigerating compartment or the freezing compartment may be pulled out. In addition, if the external diameter of the door hinge 14 is increased, the horizontal length of the refrigerator is increased or, when the door is fully opened, the door ends up taking up more outer space.

However, based on the embodiment shown in FIG. 3, only one hose 64 passes through the inside of the door hinge 14 of the freezing compartment door 12. Thus, even without increasing the external or internal diameter of the door hinge 14, the hinge strength is not deteriorated. Further, since the external diameter of the door hinge 14 is not increased, the horizontal length of the refrigerator is not increased, and the door may occupy less space when it is opened.

According to the exemplary embodiment, the refrigerator main body 11 and the freezing compartment door 12 are produced separately from each other and are combined with each other during production of the refrigerator. Thus, in the exemplary embodiment shown in FIG. 3, only one connector is needed in contrast to the conventional approach shown in FIG. 1 in which two connectors are required, thereby resulting in cost savings.

Moreover, water leakage may easily occur at a portion where a connector is connected with a hose. One connector has two connecting points for allowing hoses to be connected to both sides, respectively, of the connector. As shown in FIG. 3, the number of connectors may be reduced as compared with the conventional approach shown in FIG. 1, and, as a result, the number of connecting points may also be reduced, resulting in water leakage being ameliorated.

While the exemplary embodiment shown in FIG. 3 indicates that the filter 22 for purifying water supplied from the water supply source 21 is mounted in the refrigerating compartment, the filter 22 may be eliminated from the water supply system because purified water may also be fed from an outside source. Further, since water from the water supply source 21 may be shut on/off only by opening and closing the splitting valve 25, the switching valve 24 may also be omitted from the water supply system.

Figure 4:
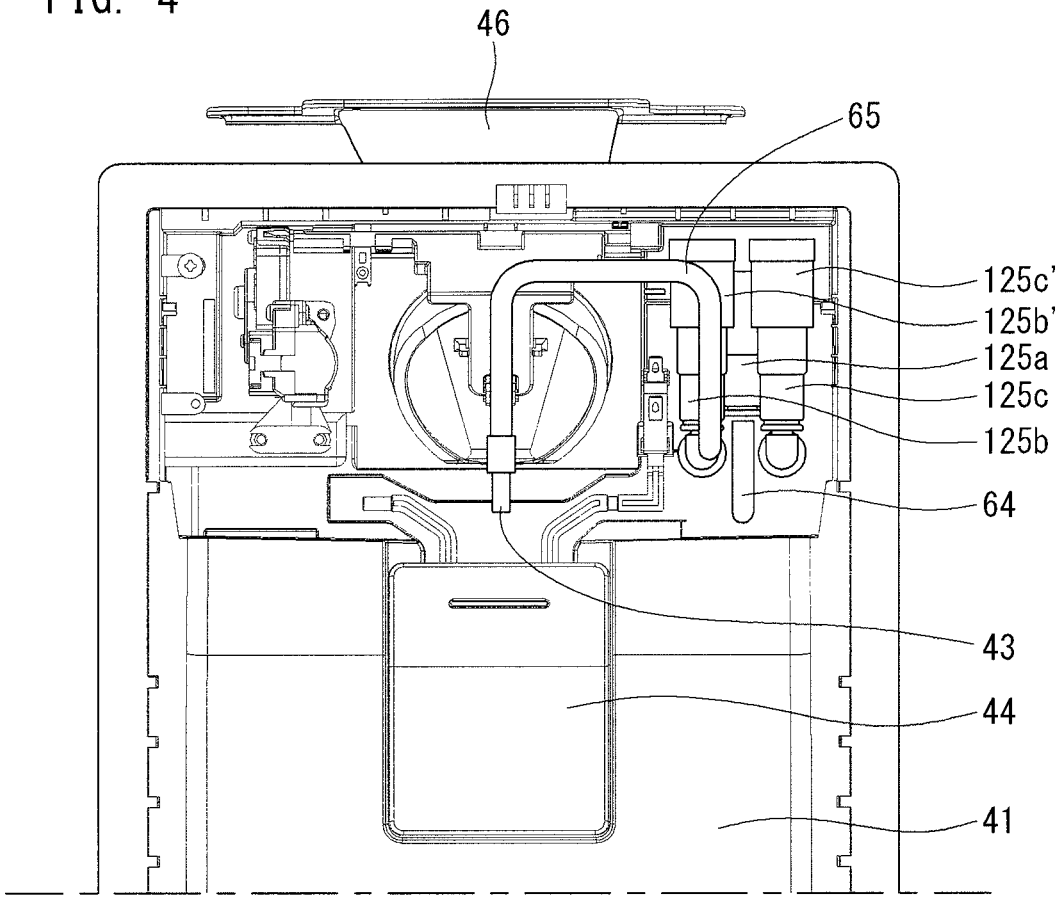
FIG. 4 shows a structure in which a dispenser and a switching valve are arranged together in a dispenser room according to an exemplary embodiment of the present invention.

FIG. 4 shows a structure in which a dispenser and a switching valve are arranged together in a dispenser room according to an embodiment of the present invention.

Because the splitting valve 125 may be installed at the rear surface of the freezing compartment door 12, the splitting valve may become frozen if the valve breaks and water leakage occurs so that water permeates into the inside of the freezing compartment. To prevent this, the splitting valve 125 can be arranged at the front surface of the freezing compartment door 12. Accordingly, the splitting valve 125, together with the dispenser, may be arranged at a depressed space of the dispenser 40 provided at the front surface of the freezing compartment door 12, for example, at an upper space of the dispenser room 41.

Figure 5:
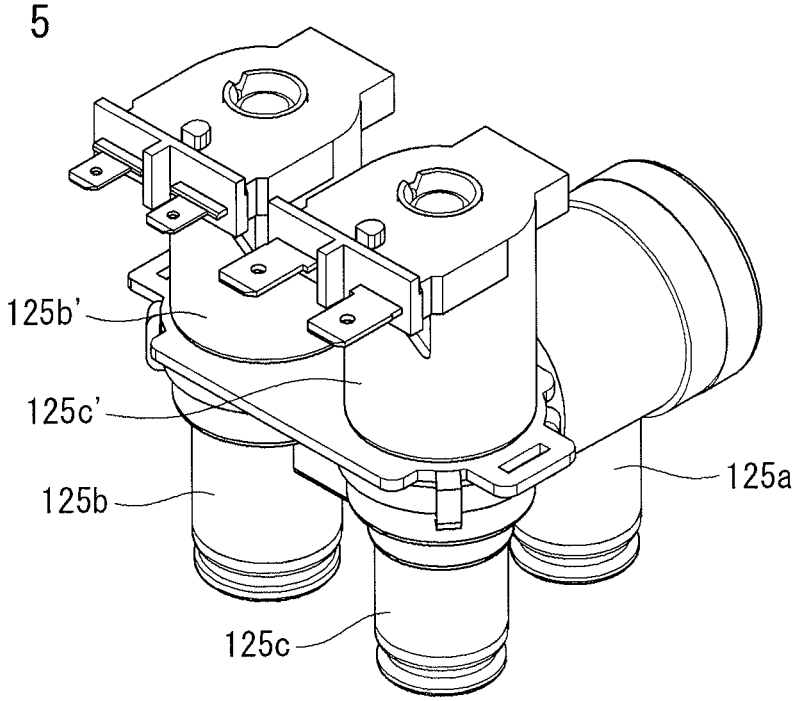
FIG. 5 shows a splitting valve for distributing water into an ice maker and a water outlet of a dispenser.

FIG. 5 shows the splitting valve 125 for distributing water into an ice maker 51 and a water outlet 43 of a dispenser 40.

The splitting valve 125 may include an inlet conduit 125*a* through which water is introduced, first and second outlet conduits 125*b* and 125*c* connected to the inlet conduit 125*a* and split from each other, and first and second opening/closing mechanisms, for example, first and second solenoid valves 125*b*' and 125*c*' for opening and closing the first and second outlet conduits 125*b* and 125*c*. Water introduced through the inlet conduit 125*a* may selectively flow into the first outlet conduit 125*b*, the second outlet conduit 125*c* or both the first outlet conduit 125*b* and the second outlet conduit 125*c* depending how the first solenoid valve 125*b*' and the second solenoid valve 125*c*' are operated.

A locking ring is mounted in each of the inlet conduit 125*a* and the outlet conduits 125*b* and 125*c* to ensure a tight coupling between a corresponding conduit and a hose inserted into the corresponding conduit, which has an external diameter similar to an internal diameter of the conduit, thus preventing water leakage.

While an inlet of the inlet conduit 125*a* and outlets of the outlet conduits 125*b* and 125*c* are shown as oriented in the same direction, the first outlet conduit 125*b* may be manufactured so that the inlet of the inlet conduit 125*a* is positioned to be perpendicular to the outlets of the outlet conduits 125*b* and 125*c*.

The solenoid valves 125*b*' and 125*c*' are provided at opposite sides of the outlets of the outlet conduits 125*b* and 125*c*, and these valves are pushed or pulled in a solenoid-operated manner to thereby shut on and off the flow of the water. As the solenoid valves 125*b*' and 125*c*' get closer to the outlet conduits 125*b* and 125*c*, the valves are closed, and thus, the water stops flowing. As the solenoid valves 125*b*' and 125*c*' get further away from the outlet conduits 125*b* and 125*c*, the water resumes flowing.

In general, when the solenoid valves are arranged side by side, as shown in FIG. 5, in the state where the solenoid valves move in a horizontal direction to thereby open and close the outlet conduits, the arrangement reduces the likelihood of leaks. However, when the solenoid valves are operated to travel in an upper and lower direction, more benefits can be obtained compared to when the valves are operated moving in the horizontal direction. For example, if the solenoid valves are arranged in the state where the valve travels down to be closed, and the outlet conduit is left closed, the valve is forced downwards due to its own weight, thus assisting in maintaining the closed state.

Also in the exemplary embodiment shown in FIG. 4, the outlet conduits 125*b* and 125*c* of the splitting valve 125 are arranged towards the front surface of the freezing compartment door 12, and the inlet conduit 125*a* is arranged towards the rear surface of the freezing compartment door 12. Further, since the splitting valve 25 is shown as being arranged at the right side of the water outlet 43 of the dispenser 40, the first outlet conduit 125*b*, which is positioned at the left side and close to the water outlet 43, is connected to the water outlet 43 of the dispenser 40, and the second outlet conduit 125*c* that is positioned at the right side is connected to the ice maker 51.

The inlet conduit 125*a* of the splitting valve 25 is connected to the hose 64 that extends from the water tank 123, passes through the inside of the door hinge 14, and is buried in the freezing compartment door 12. The first outlet conduit 125*b* is connected to the water outlet 43 of the dispenser 40 through the hose 65, which may be referred to as a water supply tube, in the dispenser room 41. The second outlet conduit 125*c* is connected to the ice maker 51 through the hose 66 embedded in the freezing compartment door 12.

Since the hose 64 connected to the inlet conduit 125*a* and the hose 66 connected to the second outlet conduit 125*c* are embedded in the freezing compartment door 12, the dispenser case 42 forming the dispenser room 41 where the splitting valve 25 is installed may have one or two holes through which the two hoses 64 and 66 are pulled out.

In an arrangement where the two hoses 64 and 66 are embedded in the freezing compartment door 12, an end of the hose 64 is exposed to the front surface of the freezing compartment door 12 through a hole of the dispenser case 42 and is connected to the inlet conduit 125*a* of the splitting valve 25. The other end of the hose 64 is exposed through the door hinge 14 positioned at a lower side of the freezing compartment door 12 and is connected via the connector 63 to the hose 62 that connects to the water tank 123. One end of the hose 66 is exposed to the front surface of the freezing compartment door 12 through a hole of the dispenser case 42 and is connected to the second outlet conduit 125*c* of the splitting valve 25. The other end of the hose 66 is exposed through a hole of the inner case of the freezing compartment door 12 and is connected to the water supply unit of the ice maker 51.

A space between an inner case and an outer case in the door of the refrigerator may be filled with a heat insulating member through a foaming process to insulate heat from the outside. After the foaming process is finished and before the inner case is assembled, various hoses embedded in the door or electrical wires may be installed. Alternatively, after the hoses or electrical wires are installed, the foaming process may be done.

According to the exemplary embodiment, the two hoses 64 and 66 are installed in the freezing compartment door 12, and the two hoses 64 and 66 are exposed through the dispenser case 42. Accordingly, if the inside of the freezing compartment door 12 is first filled with the heat insulating member, the connecting process for the hoses 64 and 66 requires that the holes be bored through the heat insulating member before the two hoses 64 and 66 are passed through holes that have been previously bored and then pass through the holes of the dispenser case 42, thus leading to an inefficient assembly process.

Accordingly, when manufacturing the freezing compartment door 12, it is advantageous to pour a foaming liquid in the freezing compartment door 12, while the two hoses 64 and 66 are held at a fixed position, to form the heat insulating member.

The two solenoid valves 125*b*' and 125*c*' of the splitting valve 125 may be shut on and off under the control of the control board installed at the rear surface of the refrigerator. However, since the path along which a control signal passes from the rear surface of the refrigerator to the inside of the freezing compartment door 12 is long, the control signal may experience noise or may otherwise cause malfunctions.

To address such problems, a sub board may be provided at an upper side of the dispenser 40, which may include a display and manipulating buttons so as to be provided in the form of a module that may control the solenoid valves 125*b*' and 125*c*' of the splitting valve 125, so that the solenoid valves 125*b*' and 125*c*' may be controlled at a close distance.

Figure 6:
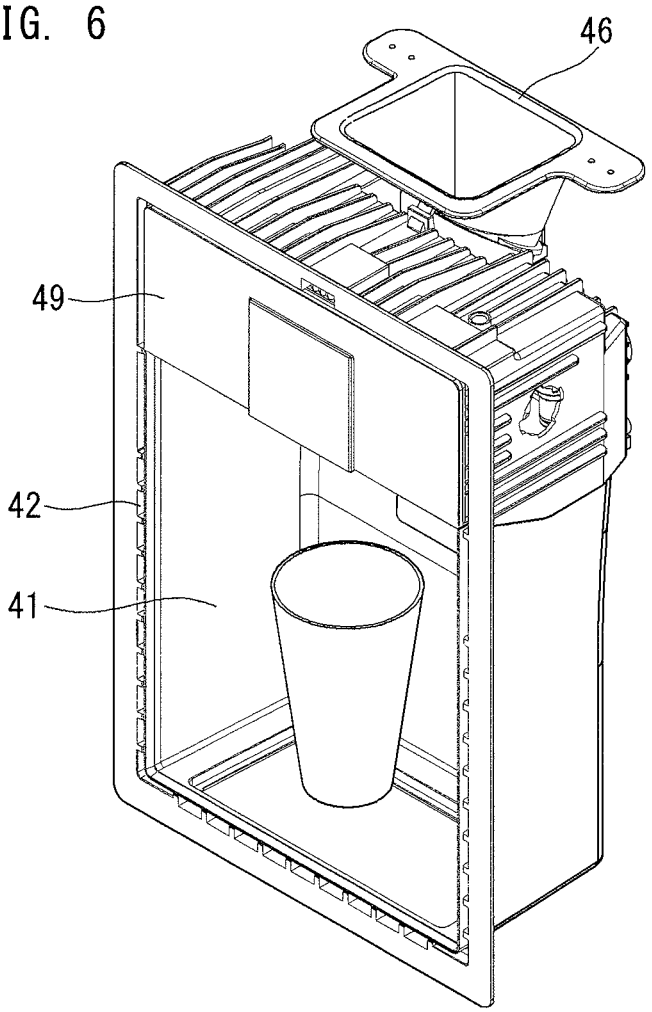
FIG. 6 shows a state where a splitting valve arranged in a dispenser room is hidden by a cover according to an embodiment of the present invention.

FIG. 6 shows a state where a splitting valve arranged in a dispenser room is hidden by a cover according to another exemplary embodiment.

The sub board having the display, manipulating buttons, and control module, mechanical parts for withdrawing water and ice, and the splitting valve 125 may be provided at an upper side of the dispenser room 41 so as to be hidden by the dispenser cover 49 and not exposed to the outside of the refrigerator.

The dispenser cover 49 is fixed to the dispenser case 42, and the display and manipulating buttons mounted on the sub board may be exposed to the front surface. A lower surface of the dispenser cover 49 also hides the sub board, the mechanical parts, and the splitting valve 125. A hole may be formed in a portion of the lower surface of the dispenser cover 49. The hole may be positioned close to the splitting valve 125 so that if the splitting valve 125 is broken and water leaks therethrough, the hole allows the water to be drained without flowing into the inside of the freezing compartment. Further, the portion of the lower surface of the dispenser cover 49, which is positioned close to the splitting valve 125, may be formed to have a cone shape or to be curved downwards, so that water leaking from the splitting valve 125 may be easily collected and drained through the hole.

Because the splitting valve 125 is mounted in the dispenser room 41 that is placed at the front surface of the freezing compartment door 12, when the splitting valve 125 breaks, repair to the splitting valve 125 may be easily carried out as compared with the case where the splitting valve 125 is installed in the mechanical chamber that is positioned at the rear and lower side of the refrigerator.

Although embodiments of the present invention have been described for the purpose of description, it will be understood by those of ordinary skill in the art that various modifications or variations may be made thereto without departing from the scope of the present invention defined by the appended claims.

What is claimed is:

1. A refrigerator, comprising:

a main body including a storage compartment;

a door to open and close the storage compartment; and a dispenser disposed at the door, the dispenser including:

a dispenser case defining a dispenser room having an upper portion and a lower portion;

a water outlet disposed within the upper portion of the dispenser room;

a water manipulating lever disposed within the upper portion of the dispenser room;

a valve device mounted on the dispenser case and located within the upper portion of the dispenser room, the valve device including a solenoid valve, wherein the solenoid valve is disposed at the upper portion of the dispenser room, and the solenoid valve is disposed at an upper side of the water outlet;

a dispenser cover mounted to an upper side of the dispenser room to cover the solenoid valve and the water outlet, the dispenser cover being exposed to an outside in a state in which the door closes the storage compartment; and a hose connecting an outlet of the solenoid valve to the water outlet, wherein the lower portion of the dispenser room and the water manipulating lever are exposed to the outside in the state in which the door closes the storage compartment, and wherein the dispenser cover is mounted to the dispenser case.

2. The refrigerator according to claim 1, wherein a display for displaying an operation status of the dispenser is exposed at a front surface of the dispenser cover.

3. The refrigerator according to claim 2, wherein the valve device is disposed at rear side of the display.

4. The refrigerator according to claim 1, further comprising a filter to purify water introduced from a water source and disposed in the storage compartment.

5. The refrigerator according to claim 4, further comprising a water tank to store water discharged from the filter and disposed in the storage compartment.

6. The refrigerator according to claim 1, further comprising an additional hose disposed in the door and connected to an inlet of the valve device.

7. The refrigerator according to claim 1, wherein the dispenser cover is detachably mounted to the dispenser case.

8. The refrigerator according to claim 7, wherein the solenoid valve is exposed to the outside when the dispenser cover is detached from the dispenser case in a state in which the door closes the storage compartment.

9. The refrigerator according to claim 1, further comprising:

an ice maker mounted on the door;

an additional solenoid valve; and an additional hose connecting an outlet of the additional solenoid valve to the ice maker.

* * * * *